US005552862A

United States Patent [19]

Masuda et al.

[11] Patent Number: 5,552,862

[45] Date of Patent: Sep. 3, 1996

[54] SERIAL-TYPE ELECTROPHOTOGRAPHIC DEVICE AND A METHOD FOR ADJUSTING PRINTING BASED UPON A DETECTED HUMIDITY USED THEREIN

[75] Inventors: Syuzo Masuda, Saijo; Ryouichi Iwama, Kawasaki, both of Japan

[73] Assignee: Fujitsu Limited, Kawasaki, Japan

[21] Appl. No.: 471,531

[22] Filed: Jun. 6, 1995

[30] Foreign Application Priority Data

Aug. 18, 1994 [JP] Japan ..... 6-194443

[51] Int. Cl.[6] ..... G03G 15/04

[52] U.S. Cl. ..... 355/208; 347/152; 400/582

[58] Field of Search ..... 355/203, 243, 355/210; 400/582, 583, 118.2; 347/133, 139, 152, 153; 358/296

[56] References Cited

U.S. PATENT DOCUMENTS 4,639,749 1/1989 Kantor et al. ..... 347/152

4,681,424 7/1989 Ito ..... 358/296

FOREIGN PATENT DOCUMENTS 61-152463 7/1986 Japan .

61-145649 9/1986 Japan .

4176679 6/1992 Japan .

*Primary Examiner*—Joan H. Pendegrass

*Assistant Examiner*—Quana Grainger

*Attorney, Agent, or Firm*—Armstrong, Westerman, Hattori, McLeland & Naughton

[57] ABSTRACT

The quality of an image can be improved by adjusting the print. When a carriage of an electrographic device is conveyed in a perpendicular direction to the feeding direction of the recording paper for exposure, development and photographic fixing, temperature and/or himidity is detected to determine an absolute humidity. The feeding amount of the paper is altered. A new feeding amount of the recording paper is determined in consideration of the altered feeding amount of the recording paper. Accordingly, the effect of shrinkage of the recording paper can be avoided, each image line can be arranged continuously and the quality of the image can be improved.

15 Claims, 14 Drawing Sheets

FIG. 7

DRY-BULB TEMPERATURE

DIFFERENCE BETWEEN DRY-BULB TEMPERATURE AND WET-BULB TEMPERATURE

| | (t − t′) | | | | | | | | | | | | | | | | | | | | |
|---|---|---|---|---|---|---|---|---|---|---|---|---|---|---|---|---|---|---|---|---|---|
| (t) | 0.0 | 0.5 | 1.0 | 1.5 | 2.0 | 2.5 | 3.0 | 3.5 | 4.0 | 4.5 | 5.0 | 5.5 | 6.0 | 6.5 | 7.0 | 7.5 | 8.0 | 8.5 | 9.0 | 9.5 | 10.0 |
| 40 | 100 | 97 | 94 | 91 | 88 | 85 | 82 | 79 | 76 | 73 | 71 | 68 | 66 | 63 | 61 | 58 | 56 | 53 | 51 | 49 | 47 |
| 35 | 100 | 97 | 93 | 90 | 87 | 83 | 80 | 77 | 74 | 71 | 68 | 65 | 63 | 60 | 57 | 55 | 52 | 49 | 47 | 44 | 42 |
| 30 | 100 | 96 | 92 | 89 | 85 | 82 | 78 | 75 | 72 | 68 | 65 | 62 | 59 | 56 | 53 | 50 | 47 | 44 | 41 | 39 | 36 |
| 25 | 100 | 96 | 92 | 88 | 84 | 80 | 76 | 72 | 68 | 65 | 61 | 57 | 54 | 51 | 47 | 44 | 41 | 38 | 34 | 31 | 28 |
| 20 | 100 | 95 | 91 | 86 | 81 | 77 | 73 | 68 | 64 | 60 | 56 | 52 | 48 | 44 | 40 | 36 | 32 | 29 | 25 | 21 | 18 |
| 15 | 100 | 95 | 89 | 84 | 78 | 73 | 68 | 63 | 58 | 53 | 48 | 44 | 39 | 34 | 30 | 25 | 21 | 16 | 12 | 8 | 4 |
| 10 | 100 | 93 | 87 | 81 | 74 | 68 | 62 | 56 | 50 | 44 | 38 | 32 | 27 | 21 | 16 | 10 | 5 | | | | |
| 5 | 100 | 92 | 84 | 76 | 68 | 60 | 53 | 46 | 38 | 31 | 24 | 16 | 9 | 2 | | | | | | | |
| 0 | 100 | 90 | 80 | 70 | 60 | 50 | 40 | 31 | 21 | 12 | 3 | | | | | | | | | | |
| −5 | 100 | 87 | 74 | 61 | 48 | 35 | 22 | 9 | | | | | | | | | | | | | |
| −10 | 100 | 82 | 64 | 47 | 29 | 12 | | | | | | | | | | | | | | | |

| e | CHANGE AMOUNT | |
|---|---|---|
| 1.0 | 0.2 % | REDUCTION IN FEED AMOUNT |
| 2.0 | 0.2 % | 〃 |
| 3.0 | 0.21% | 〃 |
| 4.0 | 0.24 % | 〃 |
| 5.0 | 0.28% | 〃 |
| 6.0 | 0.36 % | 〃 |
| 7.0 | 0.44 % | 〃 |
| 8.0 | 0.54% | 〃 |
| 9.0 | 0.63% | 〃 |
| 10.0 | 0.73% | 〃 |

FIG. 9

| | |
|---|---|
| 35° C 80% | e = 9.72 → CHANGE AMOUNT 0.7% |
| 25° C 50% | e = 5.27 → CHANGE AMOUNT 0.3% |
| 15° C 20% | e = 1.32 → CHANGE AMOUNT 0.2% |

| | | |
|---|---|---|
| 35℃ | 80% | 0.04% DEFFICIENT |
| 25℃ | 50% | 0.03% EXCESS |
| 10℃ | 20% | NO ERROR |

85

| | | |
|---|---|---|
| 35℃ 80% | 512 dot IMAGE | NO REDUCTION |
| 25℃ 50% | 509 dot IMAGE | 3 dot REDUCTION |
| 10℃ 20% | 508 dot IMAGE | 4 dot REDUCTION |

SERIAL-TYPE ELECTROPHOTOGRAPHIC DEVICE AND A METHOD FOR ADJUSTING PRINTING BASED UPON A DETECTED HUMIDITY USED THEREIN

BACKGROUND OF THE INVENTION

1. Field of the Invention

The present invention generally relates to electrophotographic devices and methods for adjusting a print used therein, and more particularly to serial-type electrophotographic devices and methods for adjusting a print used therein in which the quality of image formed is improved by the adjustment.

2. Description of the Prior Art

Currently, there is a demand for economic and small-size electrophotographic devices. Thus, a serial-type electrophotographic printer in which an electrophotographic unit is mounted in a carriage, for printing, has been developed. In this type of electrophotographic printer, an image is transcribed on recording paper by a carriage being conveyed in a perpendicular direction to a feeding direction of the recording paper. The transcribed image is fixed by a photographic fixing device provided in the feeding direction of the recording paper. In this type of electrophotographic printer, an improvement in the quality of the recorded image is desired.

FIG. 1A is a partial plan view of a conventional serial-type electrophotographic printer and FIG. 1B is a sectional view showing a carriage thereof.

A serial-type electrophotographic printer 11 shown in FIGS. 1A, 1B is disclosed in Japanese Laid-Open Patent Application No. 61-152463. In the serial-type electrophotographic printer 11, feeding rollers 13*a*, 13*b* for feeding recording paper 12 and a shaft 14 parallel to the feeding rollers 13*a*, 13*b* are provided. A removable carriage 15, guided by the shaft 14, is provided in a perpendicular direction to a feeding direction of the recording paper 12. The carriage 15 is conveyed by a driving motor (not shown). At a downstream side in the feeding direction of the recording paper 12, a photographic fixing device 16, which is longer than the width of the recording paper 12, is provided. Also, a transcription device 17 is provided under the recording paper 12 in the feeding direction of the recording paper 12.

A drum 21 which rotates at a speed in response to movement of the carriage 15 is mounted in the carriage 15. A surface of the drum 21 is uniformly charged and an electrostatic latent image is formed thereon. The electrostatic latent image is made into a visible toner image by toner 24 in a developer 25. The toner being applied by a developing roller 26. The toner image is transcribed to the recording paper 12 by the transcription device 17 which faces the drum 21 on the opposite side of the recording paper 12. The transcribed portion is photographically fixed by the photographic fixing portion 16.

In this serial-type electrophotographic device 11, feeding of the recording paper is an intermittent action. Accordingly, part of an image quality fixed when the recording paper is being fed is different from that when the recording paper is stopped. It prevents a uniform fixing quality from being conducted. For example, a part of the recording paper in contact with the fixing roller when the fixing roller is stopped has a glossy appearance.

In order to solve the above problem, a serial-type electrophotographic device has been developed in which a photographic fixing roller is provided in a carriage.

FIG. 2 is a schematic illustration showing a carriage in which a photographic fixing device is provided. A carriage 15 having a photographic fixing device 27 in FIG. 2 is disclosed in Japanese Laid-Open Utility Model Application No. 61-145649. In the carriage 15, a cleaner 30 is provided in order to remove toner particles remaining on the drum 21 after a printing cycle.

In the photographic fixing device 27, a photographic fixing roller 28 is provided which rotates in the same direction as the drum 21. In the photographic fixing roller 28, a heat source 29 (i.e. a halogen lamp) is provided. The photographic fixing roller 28 is heated by the heat source 29 before a printing operation and the temperature thereof is detected and controlled by a temperature sensor (not shown) such as a thermistor. That is, the photographic fixing device 27 is conveyed with the drum 21 in order to conduct the photographic fixing subsequent to the transcription of the image.

Since the transcription by the transcription device 17 is conducted by applying a prescribed electric voltage between the transcription device 17 and the drum 21, an electrically conductive material, such as electrically conductive gum is applied on the baseboard in the photographic fixing device 17.

In the serial-type electrophotographic printer, the photographic fixing roller operates at approximately 180° C. Since the toner 25 is fixed on the recording paper, water retained in the recording paper is vaporized and shrinks the recording paper.

FIGS. 3A, 3B and 3C are schematic illustrations describing a problem of the conventional serial-type electrophotographic printer. In FIG. 3A, each image line of width A L1, L2 . . . is printed continuously at a proper temperature at a proper humidity.

When the recording paper is shrunk by heat applied by the photographic fixing roller 28, a width of each line L1, L2 . . . becomes B and gaps C which prevent each line from being arranged continuously are formed, as shown in FIG. 3B. In this case, the quality of the image is deteriorated.

Also, when the gap C is expected and the amount of recording paper fed is reduced, each line L1, L2 . . . is overlapped because of the change of water-absorption due to a change of temperature and humidity. In this case also, the quality of the image is deteriorated.

SUMMARY OF THE INVENTION

Accordingly, it is a general object of the present invention to provide a novel and useful electrophotographic device and a method for adjusting print in which image quality of image is improved.

The above objects of the present invention are achieved by a serial-type electrophotographic device, comprising, feeding means for feeding a recording paper, a carriage having process means for forming a latent image in image retaining means and developing the latent image to a visible image, transcription means for transcribing the developed visible image to the recording paper in a moving direction of the carriage, conveyer means for conveying the carriage in a perpendicular direction to a feeding direction of the recording paper on the transcription means, photographic fixing means for fixing an image transcribed to the recording paper, environment detecting means for detecting at least one of a temperature and a humidity around the serial-type electrophotographic device, and print adjusting means for adjusting an amount of the recording paper fed by the feeding means in response to a detection of the environment detecting means so as to adjust each image line width in the feeding direction of the recording paper.

In the above invention, the print adjusting means may includes can comprises a first table in which data for determining an absolute temperature based on at least one of the temperature and the humidity detected by the environment detecting means is stored, a second table in which a change of the feeding amount of the recording paper which corresponds to the absolute humidity is stored, and first controlling means for determining the change of the feeding amount of the recording paper according to the first table and the second table and driving the feeding means.

In the above inventions, the print adjusting means can vary the feeding amount of the recording paper every prescribed number of round trips of the carriage in the printing direction.

According to the above inventions, when the carriage is conveyed in the perpendicular direction to the feeding direction of the recording paper for exposure, development and photographic fixing, the temperature and/or the humidity is detected to determine an absolute humidity and change of the feeding amount of the recording paper. The feeding amount of the recording paper is determined in consideration of the change of the feeding amount of the recording paper. Accordingly, the effect of shrinkage of the recording paper can be avoided, each image line can be arranged continuously and the quality of the image can be improved.

The above objects of the present invention are also achieved by a print adjusting method for a serial-type electrophotographic device, the serial-type electrophotographic device comprising feeding means for feeding a recording paper, process means for forming a latent image in an image retaining means and developing the latent image to a visible image, transcription means for transcribing the developed visible image to the recording paper, and photographic fixing means for fixing an image transcribed to the recording paper, the transcribed image being fixed by a heat, said print adjusting method comprising the steps of, detecting at least one of a temperature and a humidity around the serial-type electrophotographic device, determining an mount of recording paper fed in response to a shrinkage amount of the recording paper due to a heating for photographic fixing based on one of the temperature and the humidity, and driving the feeding means in response to the feeding amount of the recording paper.

In tile above invention, the feeding amount of the recording paper can be determined by a change of the feeding amount of the recording paper, the changing of the feeding amount of the recording paper being determined by an absolute humidity determined by at least one of the temperature and the humidity.

According to tile above invention, each image line can be arranged continuously and the quality of the image is improved.

The above objects of the present invention are also achieved by a serial-type electrophotographic device, comprising, feeding means for feeding a recording paper, a carriage having process means for forming a latent image in image retaining means and developing the latent image to a visible image, the latent image being formed by the image retaining means being charged by a charging device and being exposed by exposure means, transcription means for transcribing the developed visible image to the recording paper in a moving direction of the carriage, conveyer means for conveying the carriage in a perpendicular direction to a feeding direction of the recording paper on the transcription means, photographic fixing means for fixing an image transcribed to the recording paper, the image transcribed to the recording paper being fixed by a heated fixing member, environment detecting means for detecting at least one of a temperature and a humidity around the serial-type electrophotographic device, and print adjusting means for adjusting a number of image elements of exposure data transmitted to the process means in response to a detection of the environment detecting means so as to adjust width of each image line in the feeding direction of the recording paper.

In the above invention, the print adjusting means can comprise an image element reduction circuit for reducing the exposure data and second controlling means in which the exposure data is reduced by the image element reduction circuit in response to one of the temperature and the humidity.

In the above invention, the print adjusting means can further comprise a third table in which a reduced number of the image elements which corresponds to at least one of the temperature and the humidity is stored.

In the above invention, the exposure data of the image element reduction circuit can be reduced every round trip of the carriage.

According to the above inventions, when the carriage is conveyed in the perpendicular direction to the feeding direction of the recording paper for an exposure, development and photographic fixing, temperature and/or humidity is detected to determine a reduced number of image elements. The exposure process is controlled by the reduced number of image elements. Accordingly, the effect of shrinkage of the recording paper can be avoided, each image line can be arranged continuously and the image quality can be improved.

In the above invention, the print adjusting means can further comprise a random number generating circuit for determining at random a part of the image data at which the exposure data is reduced. According to the above invention, the position at which the exposure data is reduced is not fixed to a specific position and the image quality can be improved.

In the above invention, the print adjusting means can further comprise memory means for memorizing a printing data for a plurality of round trips of the carriage, the exposure data being reduced in the memory means. According to the above invention, high-speed printing with increased image quality is realized.

The above objects of the present invention are also achieved by a print adjusting method for a serial-type electrophotographic device, the serial-type electrophotographic device comprising feeding means for feeding recording paper, process means for forming a latent image ill image retaining means, the latent image being formed by the image retaining means being charged by a charging device and being exposed by exposure means, and developing the latent image to a visible image, transcription means for transcribing the developed visible image to the recording paper, and photographic fixing means for fixing an image transcribed to the recording paper, said print adjusting method comprising the steps of, detecting at least one of a temperature and a humidity around the serial-type electrophotographic device, determining a reduced number of image elements of exposure data based on at least one of the temperature and the humidity, and controlling the exposure means in response to the determined image element of exposure data. According to the above invention, each image line can be arranged continuously and a quality of image can be improved In the above invention, a part of the image data in which the exposure data is reduced is determined at random. According to the invention, a quality of tile image can be improved in appearance.

Other objects and further features of the present invention will be apparent from the following detailed description when read in conjunction with the accompanying drawings.

BRIEF DESCRIPTION OF THE DRAWINGS

FIG. 7 is a table showing data stored in a first table shown in FIG. 6;

FIG. 9 is a table showing a change of the data stored in the second table;

DESCRIPTION OF THE PREFERRED EMBODIMENTS

The preferred embodiments of the present invention will now be described in further detail with reference to the accompanying drawings.

Figure 1A:
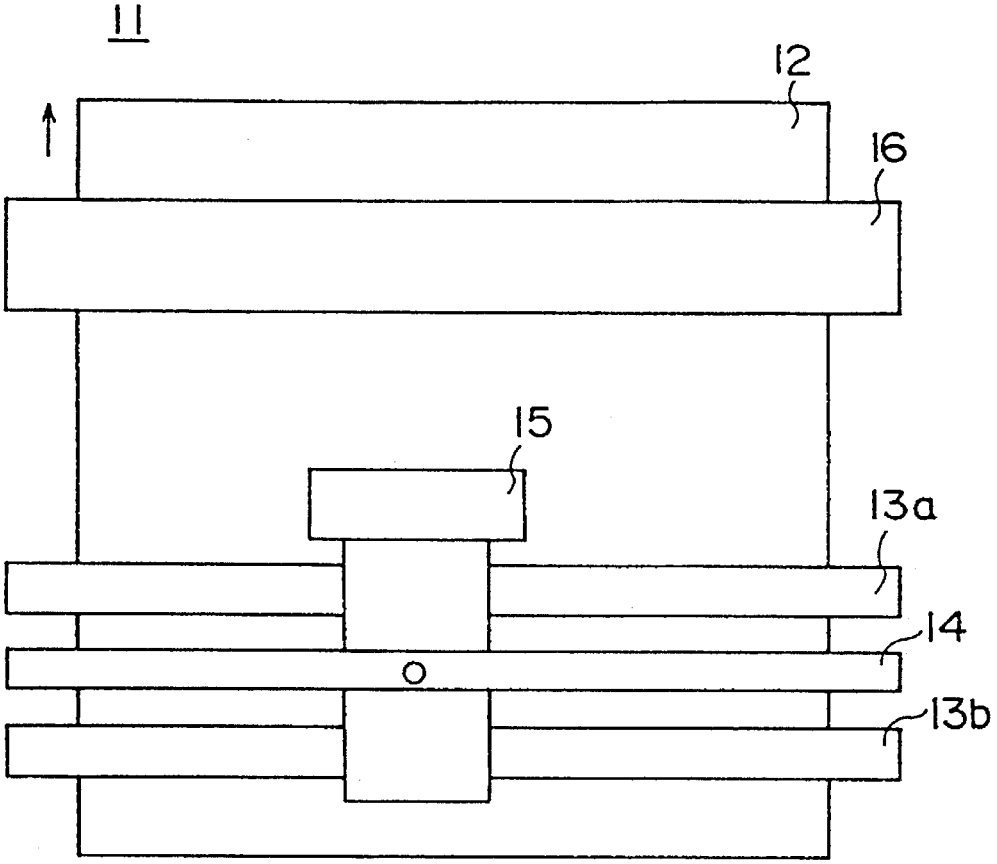
FIG. 1A PRIOR ART
FIGS. 1A, 1B are schematic illustrations showing a conventional serial-type electrophotographic printer.
Figure 1B:
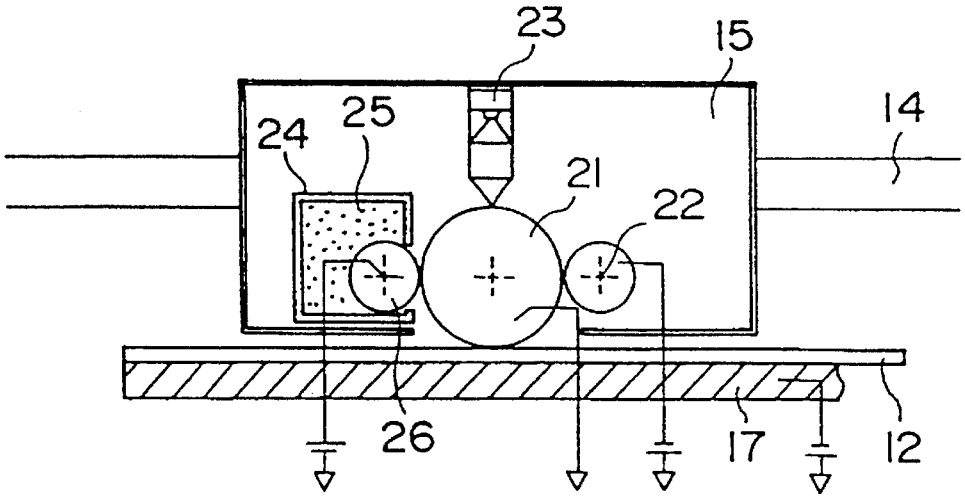
FIG. 1B PRIOR ART
Figure 2:
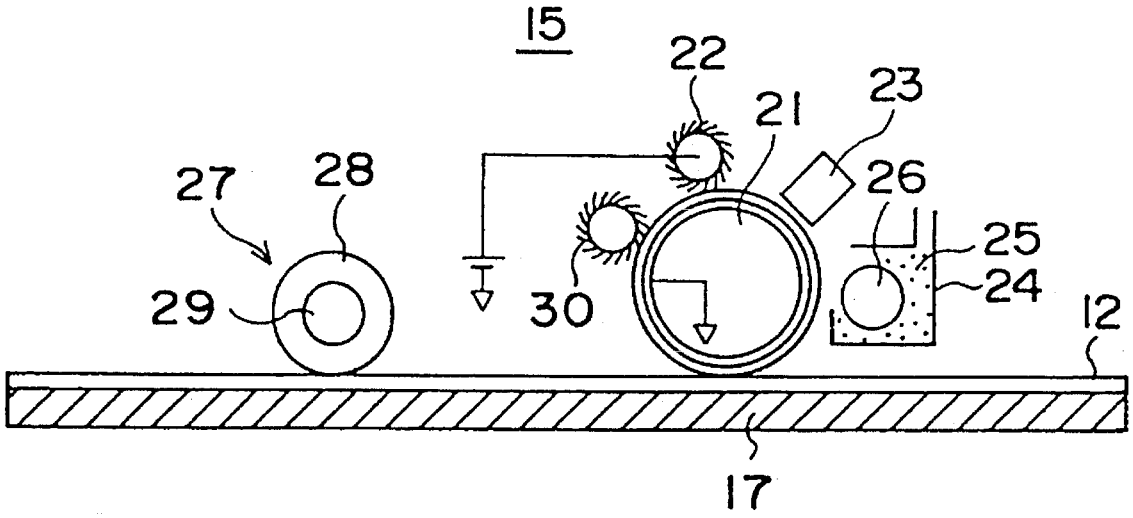
FIG. 2 PRIOR ART
FIG. 2 is a schematic illustration showing a carriage having a photographic fixing device.
Figure 3A:
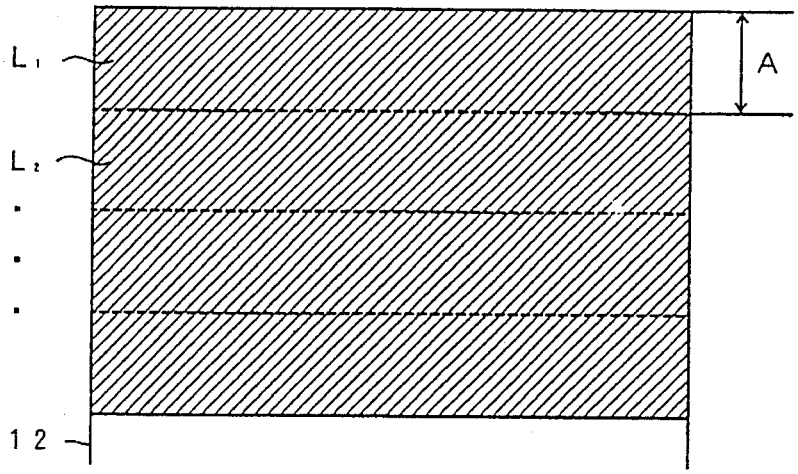
FIG. 3A PRIOR ART
FIGS. 3A, 3B and 3C are plan views showing print lines.
Figure 3B:
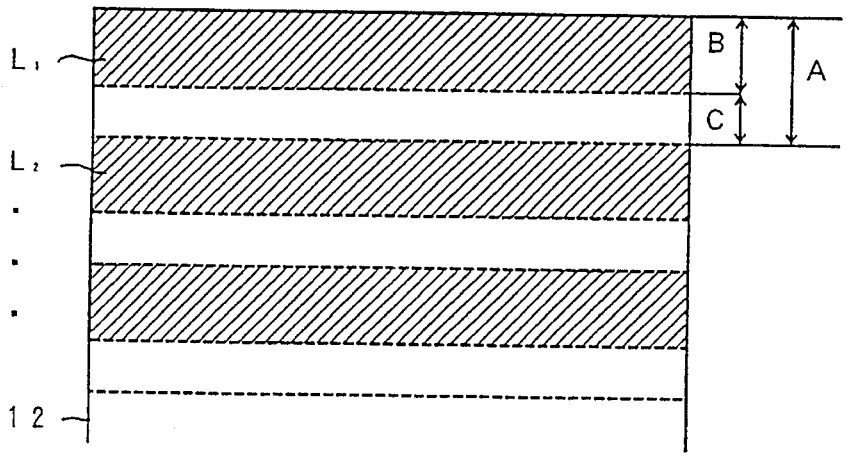
FIG. 3B PRIOR ART
Figure 3C:
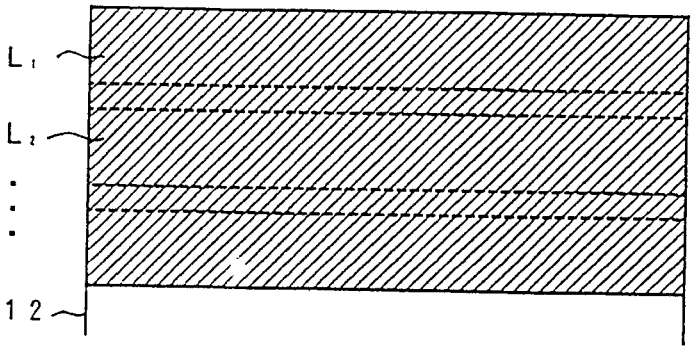
FIG. 3C PRIOR ART
Figure 4:
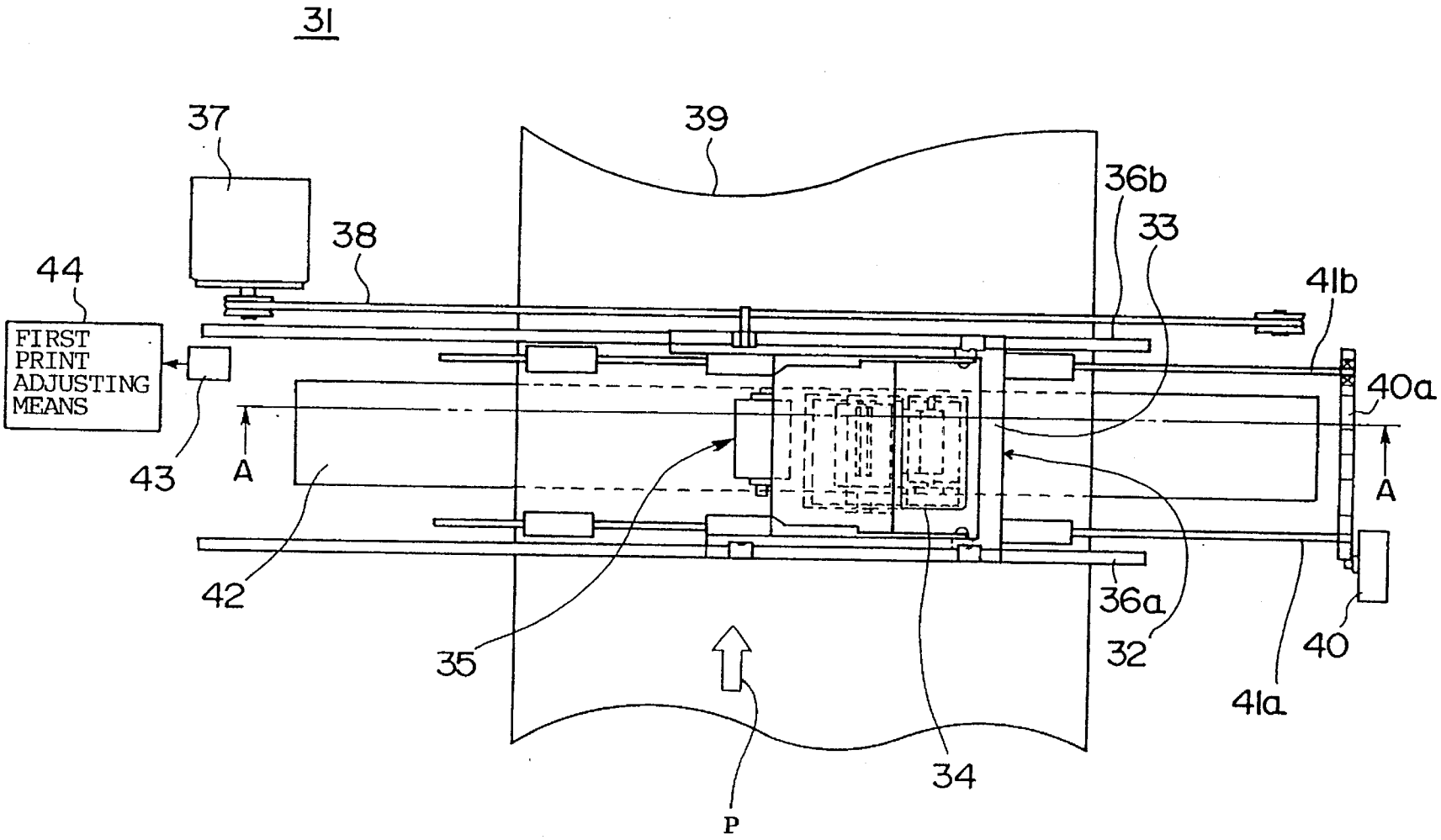
FIG. 4 is a schematic illustration showing a first embodiment of the present invention.
Figure 5:
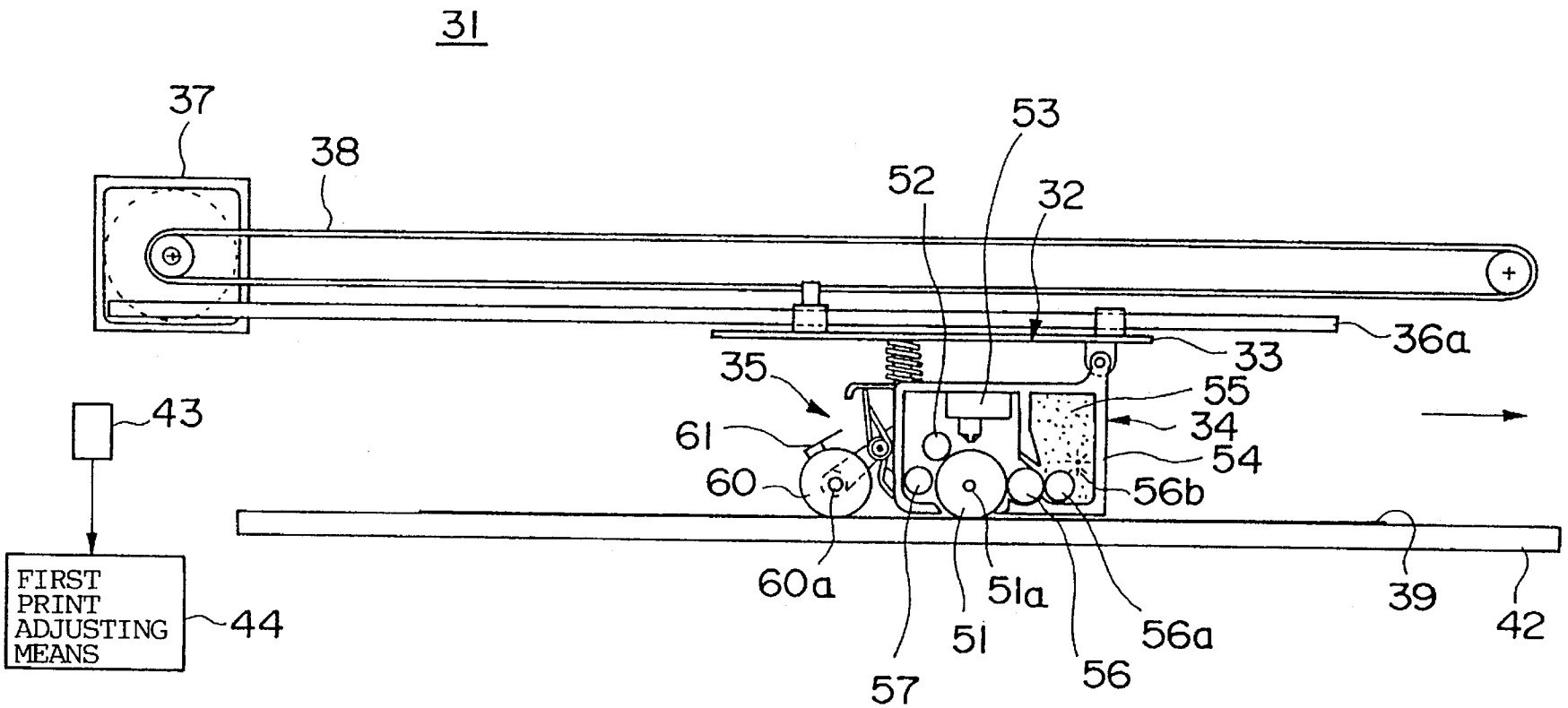
FIG. 5 is a sectional view taken on line A—A of FIG. 4.

FIG. 4 is a plan view showing a first embodiment of the present invention. FIG. 5 is a sectional view taken on line A—A of FIG. 4.

In FIG. 4, a serial-type electrophotographic printer 31 has a carriage 32. The carriage 32 comprises a slide portion 33, a process portion 34 defining process means and a photographic fixing portion 35 defining photographic fixing means. The process portion 34 and the photographic fixing portion 35 are mounted on the slide portion 33.

Recording paper 39 is fed in a direction shown by an arrow P in FIG. 4 by a driving motor 40 through a gear 40*a*. The slide portion 33 is guided by guide shafts 36*a*, 36*b*, and is conveyed in a perpendicular direction of the feeding direction of the recording paper 39 by a carrier motor 37 through a belt 38.

Under the carriage 32, a transcription device (transcription platen) 42 is arranged in a conveying direction of the carriage 32. The transcription device 42 comprises a baseboard of, for example, aluminum and a heat-resistant material (i.e. silicone gum including a conductive material) applied on a carriage side surface of the baseboard. The recording paper 39 is fed between the transcription device 42 and the carriage 32.

A temperature-humidity sensor 43 functioning as environment detecting means is provided at a desired position around the features described above. In order to detect the temperature, for example, a thermistor is used.

An output signal of the temperature-humidity sensor 43 is transmitted to first print adjusting means 44. The first print adjusting means 44 controls the amount of recording paper 39 fed by the driving motor 40 and adjusts the width of an image in the feeding direction of the recording paper in response to temperature and humidity detected by the temperature-humidity sensor 43, as described later.

In the process portion 34 of the carriage 32, a recording drum having a rotational axis 51*a*, parallel to the feeding direction of the recording paper, is provide as image retaining means, as shown in FIG. 5. The recording drum 51 rotates in coordination with the speed of the carriage 32 on the recording paper 39 on the transcription device 42.

On a surface of the recording drum 51, an electrostatic latent image is formed by an exposure element (LED) 53 as exposure means provided above the drum 51. The exposure element 53 is charged uniformly by a charging device 52. The latent image is developed into a visible image by a toner stored in the developing device 54 as developing means. The toner is supplied to the drum 51 by a developing roller 56. The toner image is transcribed on the recording paper 39 by applying a prescribed electric voltage between the drum 51 and the transcription device 41 facing the recording drum 51 through the recording paper 39. The developing roller 56 rotates at a higher speed than the recording drum.

The developing device 54 has a supply roller 56*a* for supplying the toner to the developing roller 56 and a paddle 56*b* for agitating the toner in the developing device 54. The developing device 54 has a cleaner 57 for removing unused toner particle remaining on the recording drum 51.

In the photographic fixing portion 35 mounted on the carriage 32 with process portion 32, a photographic fixing roller 60 is provided with a halogen lamp 60*a* as heating means. The photographic fixing roller 60 is made of magnetic material such as iron and the surface thereof is coated with a protective material. The photographic fixing roller 60 has a thermistor 61 as temperature detecting means and is maintained at a prescribed temperature.

When tile carriage 32 is conveyed in the perpendicular direction to the feeding direction of the recording paper 39 in the serial-type electrophotographic printer 31, an image transcription by the process portion 34 and a photographic fixing by the photographic fixing roller 60 of the photographic fixing portion 35 are conducted in the direction shown by the arrow. When the carriage 32 returns to its original position, the image is not formed. That is, during a round trip of the carriage 32, one line of image is formed on the recording paper. A prescribed amount of the recording paper which corresponds to one line of the image is fed by the driving motor 40 and driving rollers 41*a*, 41*b*.

Figure 6:
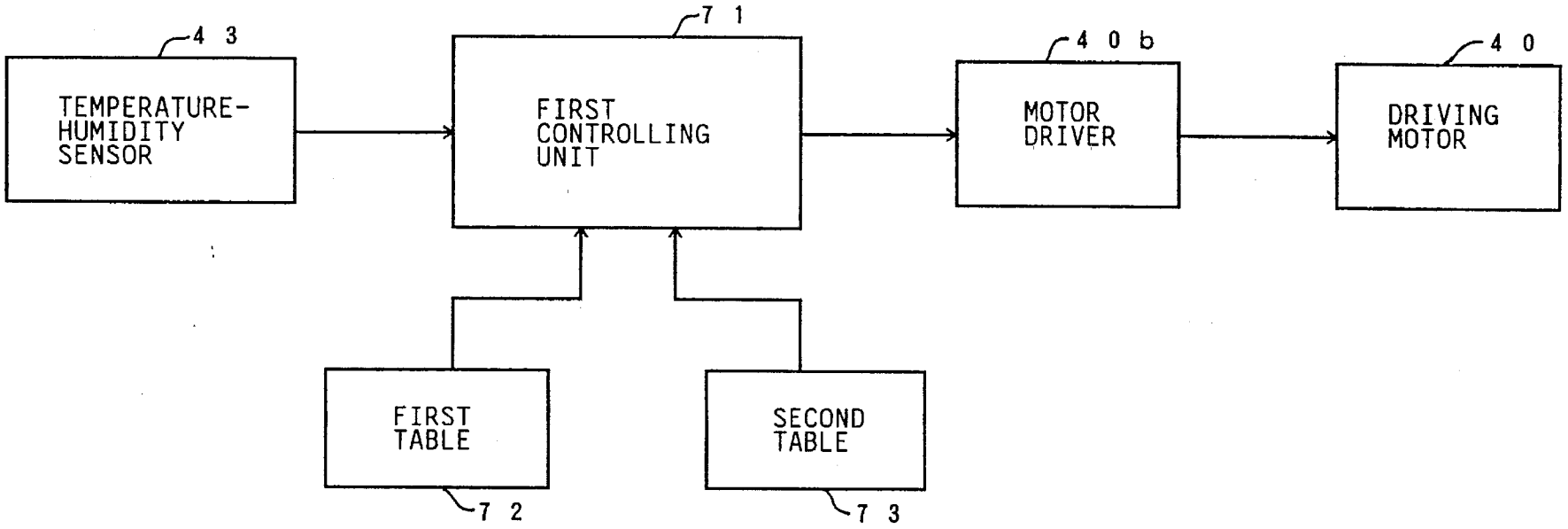
FIG. 6 is a block diagram showing print adjusting means shown in FIG. 4.

FIG. 6 is a block diagram showing first print adjusting means shown in FIG. 4. In FIG. 6, a first controlling unit 71 as first controlling means has a first table 72 and a second table 73, which constitute first print adjusting means 44. In the first table 72, data for determining an absolute humidity corresponding to a temperature and a humidity is stored (Cf. FIG. 7).

Figures 8A, 8B:
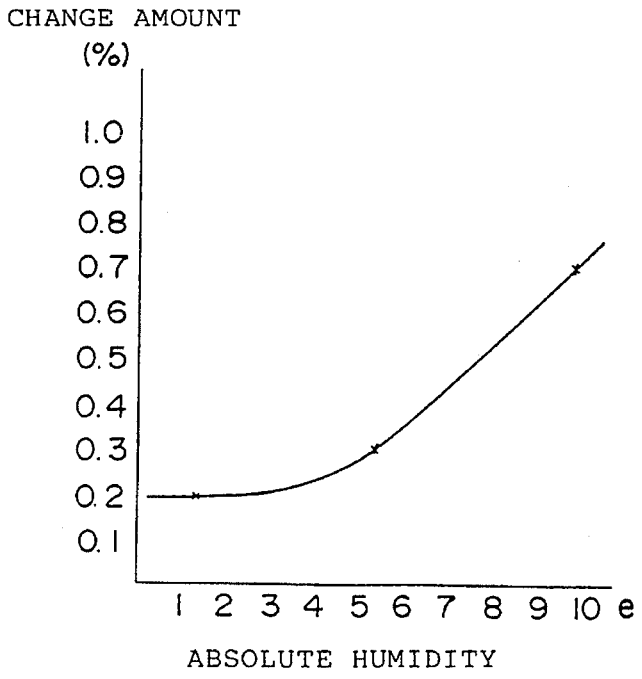
FIG. 8A is a table showing data stored in a second table shown in FIG. 6
FIG. 8B is a graph showing thereof.

In the second table 73, a change of the feeding amount of the recording paper 39 which corresponds to the temperature and the humidity is stored (Cf. FIGS. 8A and 8B).

Data of the temperature and the humidity detected by the temperature-humidity sensor 43 is transmitted to the first controlling unit 71. The first controlling unit 71 determines a change of the feeding amount of the recording paper and add it to the predetermined amount of feeding so as to adjust the driving motor 40, as shown later with reference to FIG. 9.

FIG. 7 is a table showing data stored in the first table shown ill FIG. 6. FIG. 8A is a table showing a data stored in the second table shown in FIG. 6 and FIG. 8B is a graph showing a data stored in the second table.

In tile first table 72 shown in FIG. 7, data for determining the absolute humidity based on the temperature and the humidity is stored. In FIG. 7, a relative humidity is determined based on a wet-bulb temperature (t° C.), a dry-bulb temperature (t'° C.) and a difference between the dry-bulb temperature and the wet-bulb temperature (t–t').

Therefore, in order to determine the absolute humidity, the difference of the dry-bulb temperature and the wet-bulb temperature is determined in the first table 72.

That is, an absolute humidity (vapor pressure) e in the serial-type electrophotographic printer 31 is determined by a following equations in which t represents a dry-bulb temperature (° C.), t' represents a wet-bulb temperature (° C.), Ew represents a saturation vapor pressure at t° C. and P represents an atmospheric pressure (1013.25 hPd).

$$e=Ew-0.008\cdot P\cdot(t-t')$$

$$H=(e/Ew)\cdot 100$$

From the above equations, the absolute humidity e is determined by the following equation;

$$e=\{H/(100-H)\}\cdot 0.0008\cdot 1013.25\cdot(t-t')$$

The relative humidity (H) is a detected humidity from the temperature-humidity sensor 43 and the dry-bulb temperature t is a detected temperature from the temperature-humidity sensor 43. Accordingly, by obtaining the difference between the wet-bulb temperature and the dry-bulb temperature (t–t'), the absolute humidity e can be determined.

For example, when t is 35° C. and H is 80%, (t–t') is determined to be 3.0, according to the first table 72. When the detected temperature t is, for example, 34° C., the humidity H is 75%, the closest values in the first table 72 must be selected.

The change of the feeding amount (%) of the recording paper 39 is determined by experiments in advance and data thereof are stored in the second table 73. FIG. 8A is a table showing the data and FIG. 8B is a graph of the data.

If the absolute humidity e is between the value shown in FIG. 8A and FIG. 8B, an adjustment must be conducted. FIG. 9 is a table showing such an adjustment when the absolute humidity is between the values shown in FIGS. 8A and 8B. As shown in FIG. 9, when the temperature is 35° C. and the relative humidity is 80%, the absolute humidity is 9.72. In this case, the change is determined to be 0.7%. Also, when the temperature is 25° C. and the relative humidity is 50%, the absolute humidity is 5.27. In this case, the change is determined to be 0.3%. Further, when the temperature is 10° C. and the relative humidity is 20%, the absolute humidity is 1.32. In this case, the change is determined to be 0.2%.

Figure 10A:
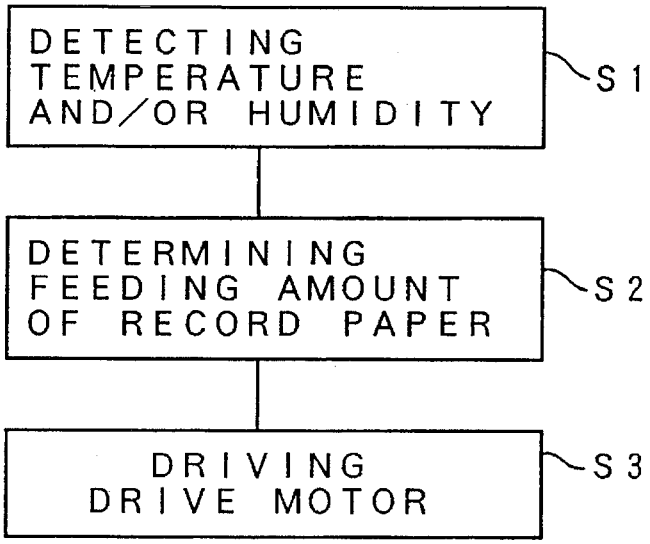
FIGS. 10A, 10B are flowcharts showing a method for determining a change in the feeding amount of recording paper.
Figure 10B:
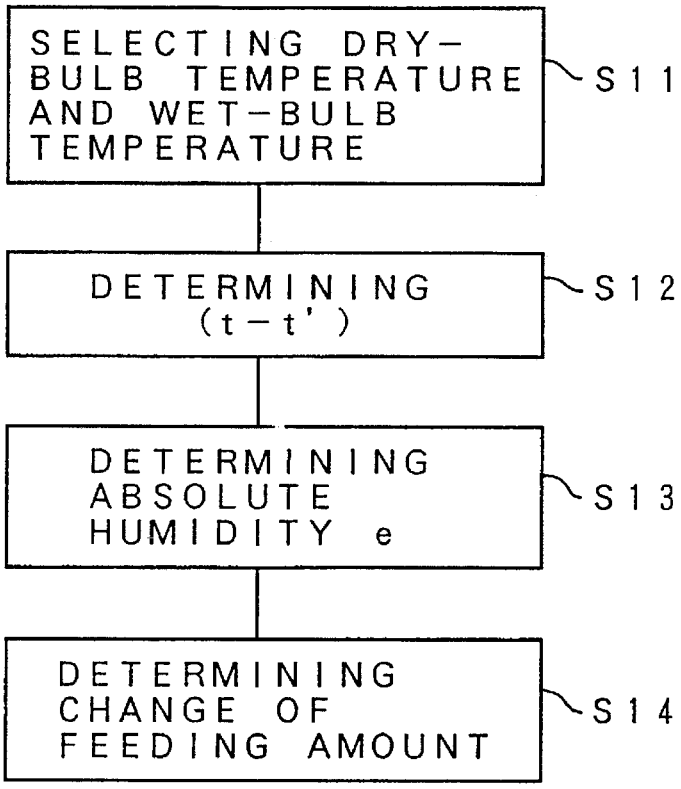

FIGS. 10A and 10B is a flowchart showing steps for determining the change of the feeding amount of the recording paper 39. The process for determining the change of the feeding amount of the recording paper will be described with reference to FIGS. 10A, 10B and FIG. 6. In FIG. 10A, the temperature and the humidity are determined by the temperature-humidity sensor 43 (Step S1). The data is transmitted to the first controlling unit 71.

In the first controlling unit 71, the change in the feeding amount of the recording paper is determined based on the detected temperature and the humidity according to tile first and second table 72, 73 (Step S2, described later referring to FIG. 10B). The first controlling unit drives the driving motor 40 via a motor driver **40*b* in response to the feeding amount of the recording paper 39** (Step S3).

in FIG. 10B, the first controlling unit 71 determines the dry-bulb temperature and the relative humidity which correspond to the values in the first table 72, based on tile temperature and tile humidity detected by the temperature-humidity sensor 43 (Step S11).

Subsequently, the difference between the dry-bulb temperature and the wet-bulb temperature (t–t') is obtained (Step S12)to determine an absolute humidity e (Step S13). The change in the amount of paper to be fed is determined based on the absolute humidity e according to the second table 73 (Step S14).

Figures 11A, 11B:
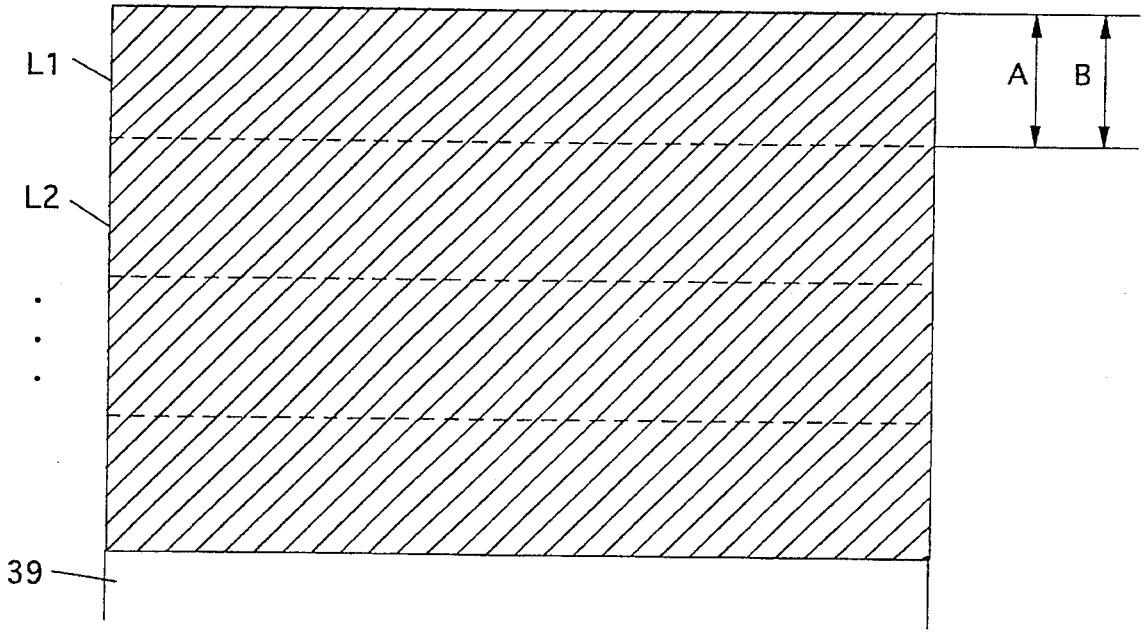
FIG. 11A is a table showing advantages of the change of the feeding amount of the recording paper and FIG. 11B is a plan view showing image lines.

FIGS. 11A and 11B shows an advantage to changing feeding amount of the recording paper 39. FIG. 11A is a table showing a data obtained by experiments in FIG. 11A, when the temperature was 35° C. and the relative humidity was 80%, 0.04% of the recording paper was deficient to be fed, which led to an overlap of image lines. When the temperature was 25° C and the relative humidity was 50%, 0.03% of the recording paper was excessively fed, which produced gaps between image lines. When the temperature was 10° C. and the relative humidity was 20%, no error in feeding the recording paper 39 was observed.

The above errors in feeding the recording paper 39 occurred due to the error in selecting the dry-bulb temperature and the relative humidity in the first table 72. However, the error of 0.04% or 0.03 is negligible. In this case, the gaps between the image line or the overlappings of the image lines in the feeding direction of the recording paper 39 could not be observed. The foregoing is an example of the degree of accuracy which can be obtained by use of the present monitoring and paper feed control system.

That is, when a feeding amount A of the recording paper 39, on which an image is printed, is controlled to be equivalent to the image line width B which shrinks due to heating of photographic fixing, the gaps or tile overlappings is prevented and the image quality is improved, as shown in FIG. 11B.

In the first embodiment described above, the humidity sensor of the temperature-humidity sensor 43 detects the relative humidity. However, if the humidity sensor of the temperature-humidity sensor 43 detects the absolute humidity, the first table 72 can be omitted.

Figure 12:
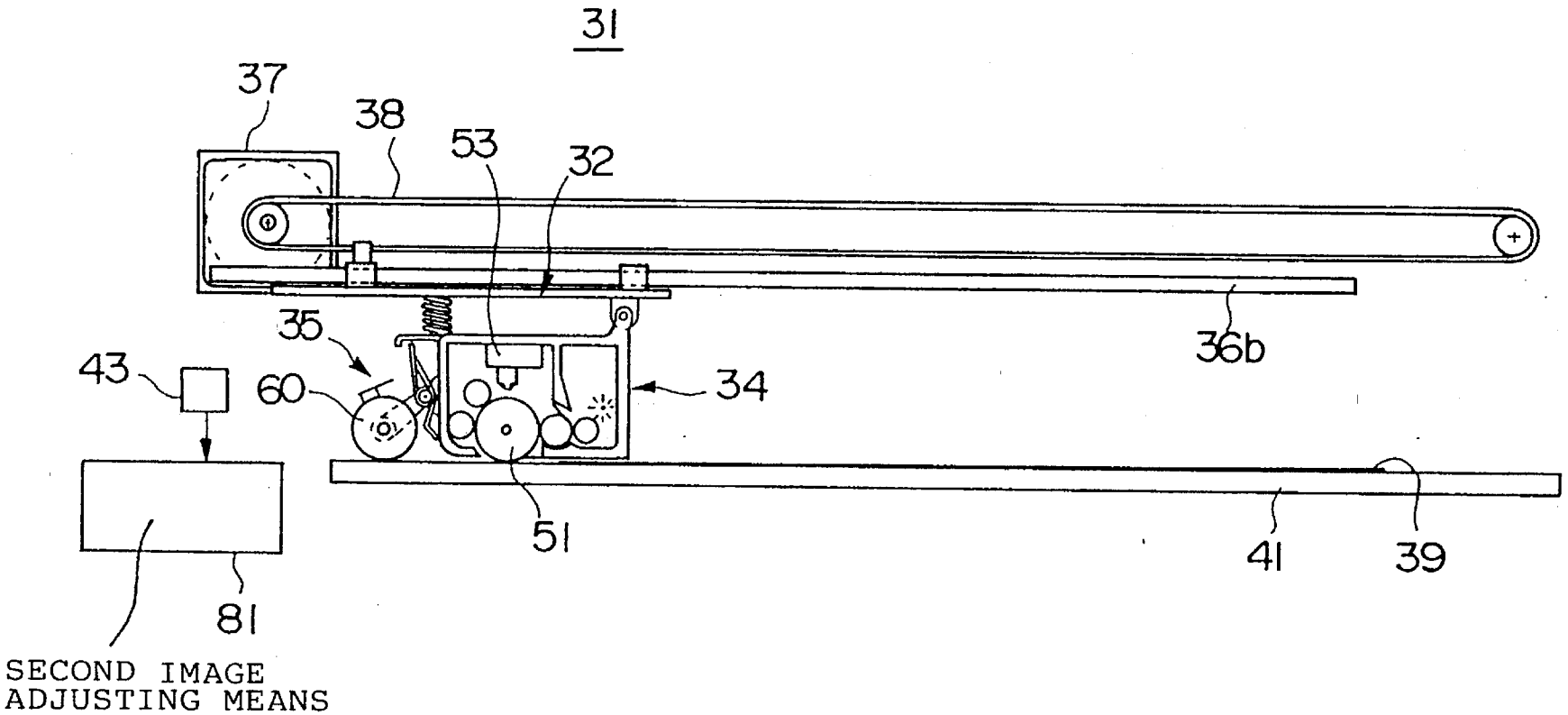
FIG. 12 is a schematic illustration showing a second embodiment of tile present invention.

FIG. 12 is a schematic illustration showing a second embodiment of the present invention. In FIG. 12, the same features as those previously described in the description of the first embodiment are denoted by the same reference numerals and the descriptions thereof are omitted.

In a serial-type electrophotographic device 31 of the second embodiment shown in FIG. 12, the temperature and the humidity detected by the temperature-humidity sensor 43 is transmitted to second print adjusting means 81. Other features are the same as those of the electrophotographic device 31 of the first embodiment. The second print adjusting means 81 controls the number of image elements of the exposure data supplied to the exposure device 53 of the process portion 34 in response to the temperature and the humidity detected by the temperature-humidity sensor 43 to adjust an image line width in the feeding direction of the recording paper.

Figures 13A, 13B:
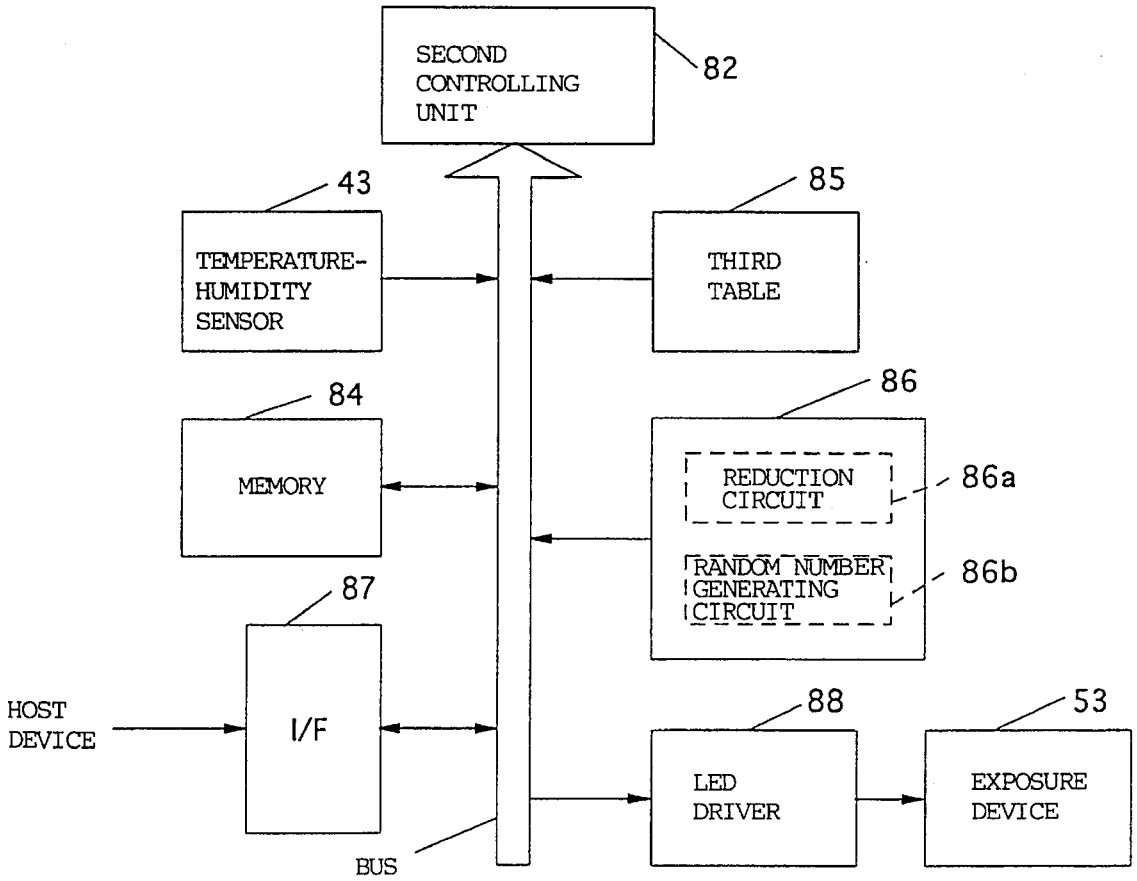
FIG. 13A is a block diagram showing second print adjusting means in the second embodiment of the present invention.
FIG. 13B is a table showing data stored in second print adjusting means in the second embodiment of the present invention.

FIG. 13A is a block diagram showing the second print adjusting means and FIG. 13B is a table showing a data stored in a third table.

In FIG. 13A, a second controlling unit 82 is communicated with a memory 84, a third table 85 and a dot amending circuit 86 via a bus 83 to constitute the second print adjusting means 81. The dot amending circuit comprises an image element reduction circuit 86*a* and a random number generating circuit 86*b*.

From a host device, various information such as image data and commands are put into an interface (I/F) 87 connected to the bus 83. A LED driver 88 connected to the bus 83 is driven by the second controlling unit 82 to supply image exposure data to an exposure device 53.

In the third table 85, image data is stored. That is, when the temperature is 35° C. and the humidity is 80%, a 512 dot image whose width is 32 mm is formed on the recording paper. That is, 16 dots corresponds to 1 mm of image line width. This a standard for the image line and the number of dots is not reduced in this case. Also, when the temperature is 25° C. and the humidity is 50%, a 509 dot image in the recording paper feeding direction is formed, that is three dots are reduced from the standard number of dots. Further, when the temperature is 10° C. and the humidity is 20%, 508 dots image in the recording paper feeding direction is formed, that is, four dots are reduced from the standard number.

Figure 14:
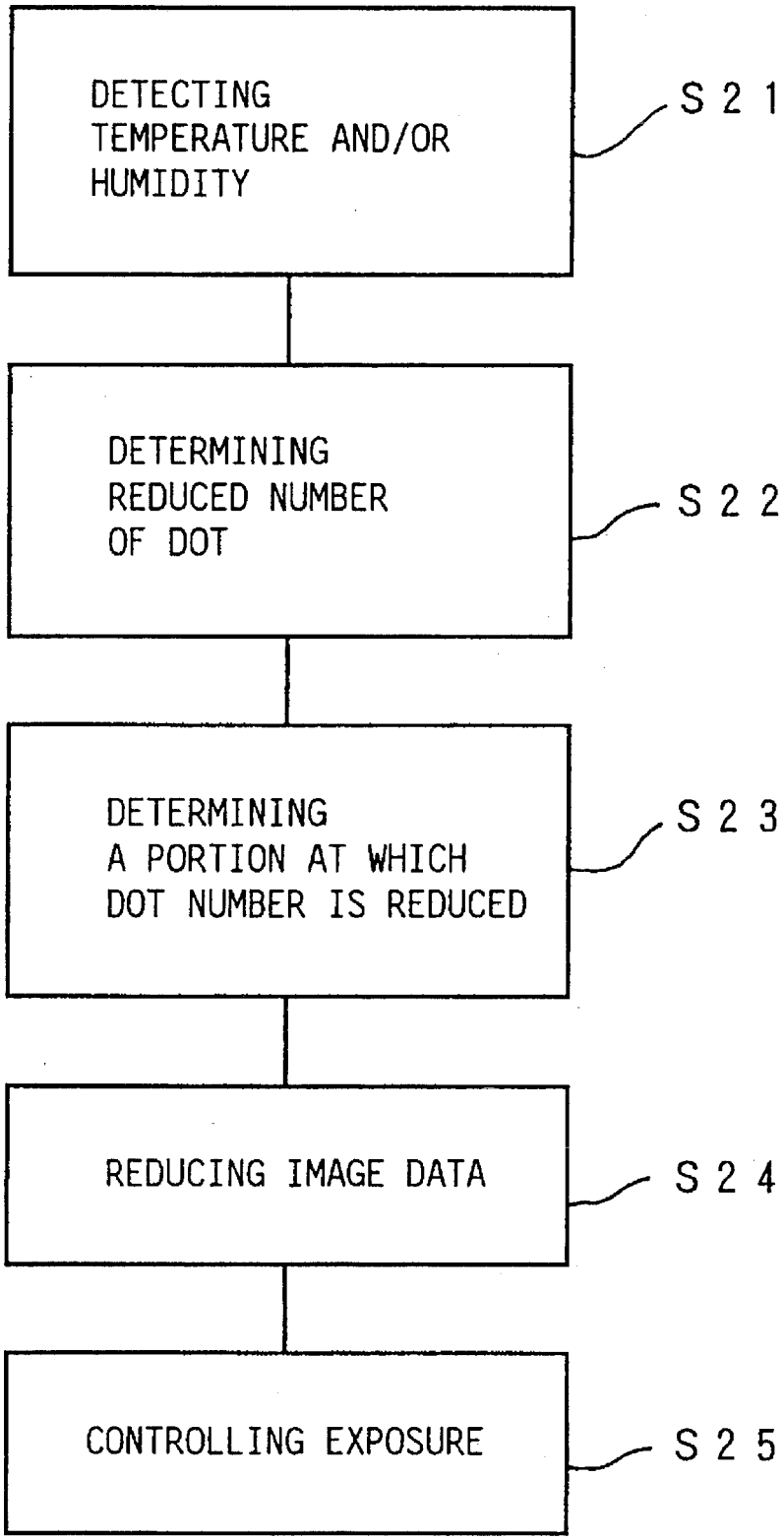
FIG. 14 is a flowchart showing a method for adjusting print used in the second embodiment of the present invention.

FIG. 14 is a flowchart showing a method for adjusting a print line. The method for adjusting is described with reference to FIGS. 13A, 13B and FIG. 14. In general, the feeding amount of the recording paper 39 fed by the feeding motor 40 is set so that each image line is formed continuously when the shrinkage amount of the recording paper is maximum. For example, the shrinkage amount is 0.66% at 35° C. temperature at 80% humidity, a number of the dots is 512 (512/16= 32 mm) and the amount of recording paper fed is set to 31.79 mm. In this case, each image line is overlapped due to a change in the temperature and the humidity.

When the temperature and the humidity detected by the temperature-humidity sensor 43 is input into the second controlling unit 82 (Step S21), the second controlling unit 82 determines the reduction in the number of dots according to the third table (Step S22).

The random number generating circuit 86b of the dot amending circuit 86 determines a position at which the number of dots is reduced in image line width (Step S23) in tile image element reduction circuit, image data for one round trip of the carriage 32, which is transmitted frown the host device via I/F 87 is reduced at a position determined by the second controlling unit 82 (Step S24). The exposure is controlled by the reduced image data as an exposure data transmitted to the exposure device 53 via the LED driver 88 (Step S25).

When the host device transmits image data for a plurality of round trips of the carriage 32, for example, an image data for one sheet of recording paper, the image data is once stored in the memory 84 in which the image data is reduced at a position decided in S23 in FIG. 14, as described in Step 24 in FIG. 14. In this case, whole image data is reduced at a same time and a high-speed printing can be realized.

By reducing the dot number which corresponds to the overlapping amount of each image line, each image line is formed continuously and evenly and image quality is improved.

In the first and the second embodiments described above, the temperature-humidity sensor 43 is used as the environment detecting means. However, the environment detecting means is realized by only a temperature sensor or by only a humidity sensor. In this case, data for determining an absolute humidity or a reduced number of dots based on the temperature or the humidity can be stored in the first table 72 or the third table 85.

Further, the present invention is not limited to these embodiments, but various variations and modifications may be made without departing from the scope of the present invention.

What is claimed:

1. A serial-type electrophotographic device, comprising:

feeding means for feeding a recording paper;

a carriage having process means for forming a latent image in image retaining means and developing the latent image to a visible image;

transcription means for transcribing said developed visible image to said recording paper in a moving direction of said carriage;

conveyer means for conveying said carriage in a perpendicular direction to a feeding direction of said recording paper on said transcription means;

photographic fixing means for fixing an image transcribed to said recording paper;

environment detecting means for detecting at least a humidity around said serial-type electrophotographic device; and print adjusting means for adjusting an amount of the recording paper fed by said feeding means in response to the detected humidity detected by said environment detecting means so as to adjust each image line width in said feeding direction of said recording paper.

2. The serial-type electrophotographic device according to claim 1, wherein said print adjusting means comprises a first table in which data for determining an absolute temperature based on at least one of a temperature and said humidity detected by said environment detecting means is stored, a second table in which a change of the feeding amount of said recording paper which corresponds to said absolute humidity is stored, and first controlling means for determining said change of the feeding amount of said recording paper according to said first table and said second table and driving said feeding means.

3. The serial-type electrophotographic device according to claim 2, wherein said print adjusting means varies said feeding amount of said recording paper every prescribed number of round trips of said carriage in said printing direction.

4. The serial-type electrophotographic device according to claim 1, wherein said print adjusting means varies said feeding amount of said recording paper every prescribed number of round trips of said carriage in said printing direction.

5. A print adjusting method for a serial-type electrophotographic device, said serial-type electrophotographic device comprising feeding means for feeding a recording paper, process means for forming a latent image in image retaining means and developing said latent image to a visible image, transcription means for transcribing said developed visible image to said recording paper, and photographic fixing means for fixing an image transcribed to said recording paper, said transcribed image being fixed by heat, said print adjusting method comprising the steps of:

detecting at least one of a temperature and a humidity around said serial-type electrophotographic device;

determining an amount of recording paper fed in response to a shrinkage amount of said recording paper due to a heating for photographic fixing based on one of said temperature and said humidity; and driving said feeding means in response to said feeding amount of said recording paper.

6. The print adjusting method for a serial-type electrophotographic device according to claim 5, wherein said feeding amount of said recording paper is determined by a change of the feeding amount of said recording paper, said changing of said feeding amount of said recording paper being determined by an absolute humidity determined by at least one of said temperature and said humidity.

7. A serial-type electrophotographic device, comprising:

feeding means for feeding a recording paper;

a carriage having process means for forming a latent image in image retaining means and developing said latent image to a visible image, said latent image being formed by said image retaining means being charged by a charging device and being exposed by exposure means;

transcription means for transcribing said developed visible image to said recording paper in a moving direction of said carriage;

conveyer means for conveying said carriage in a perpendicular direction to a feeding direction of said recording paper on said transcription means;

photographic fixing means for fixing an image transcribed to said recording paper, said image transcribed to said recording paper being fixed by a heated fixing member;

environment detecting means for detecting at least one of a temperature and a humidity around said serial-type electrophotographic device; and print adjusting means for adjusting a number of image elements of exposure data transmitted to said process means in response to a detection of said environment detecting means so as to adjust width of each image line in said feeding direction of said recording paper.

8. The serial-type electrophotographic device according to claim 7, wherein said print adjusting means comprises an image element reduction circuit for reducing said exposure data and second controlling means in which said exposure data is reduced by said image element reduction circuit in response to one of said temperature and said humidity.

9. The serial-type electrophotographic device according to claim 8, wherein said print adjusting means further comprises a random number generating circuit for determining at random a part of said image data at which said exposure data is reduced.

10. The serial-type electrophotographic device according to claim 9, wherein said print adjusting means further comprises a third table in which a reduced number of said image elements which corresponds to at least one of said temperature and said humidity is stored.

11. The serial-type electrophotographic device according to claim 8, wherein said print adjusting means further comprises a third table in which a reduced number of said image elements which corresponds to at least one of said temperature and said humidity is stored.

12. The serial-type electrophotographic device according to claim 7, wherein said exposure data of said image element reduction circuit is reduced every round trip of said carriage.

13. The serial-type electrophotographic device according to one of claim 7, wherein said print adjusting means further comprises memory means for memorizing a printing data for a plurality of round trips of said carriage, said exposure data being reduced in said memory means.

14. A print adjusting method for a serial-type electrophotographic device, said serial-type electrophotographic device comprising feeding means for feeding recording paper, process means for forming a latent image in image retaining means, said latent image being formed by said image retaining means being charged by a charging device and being exposed by exposure means, and developing said latent image to a visible image, transcription means for transcribing said developed visible image to said recording paper, and photographic fixing means for fixing an image transcribed to said recording paper, said print adjusting method comprising the steps of:

detecting at least one of a temperature and a humidity around said serial-type electrophotographic device;

determining a reduced number of image elements of exposure data based on at least one of said temperature and said humidity; and controlling said exposure means in response to said determined image element of exposure data.

15. The print adjusting method for a serial-type electrophotographic device according to claim 14 wherein a part of said image data in which said exposure data is reduced is determined at random.

* * * * *